US009787004B2

(12) United States Patent
Dinh et al.

(10) Patent No.: US 9,787,004 B2
(45) Date of Patent: Oct. 10, 2017

(54) FLOOR GROUND CLAMP

(71) Applicant: Thomas & Betts International LLC, Wilmington, DE (US)

(72) Inventors: Cong Thanh Dinh, Collierville, TN (US); George Braxton Robertson, Cordova, TN (US)

(73) Assignee: THOMAS & BETTS INTERNATIONAL LLC, Wilmington, DE (US)

( * ) Notice: Subject to any disclaimer, the term of this patent is extended or adjusted under 35 U.S.C. 154(b) by 25 days.

(21) Appl. No.: 15/098,994

(22) Filed: Apr. 14, 2016

(65) Prior Publication Data

US 2016/0344112 A1 Nov. 24, 2016

Related U.S. Application Data

(60) Provisional application No. 62/164,074, filed on May 20, 2015.

(51) Int. Cl.

| | |
|---|---|
| ***H01R 4/40*** | (2006.01) |
| ***H01R 43/20*** | (2006.01) |
| ***H01R 4/26*** | (2006.01) |
| ***H01R 4/38*** | (2006.01) |
| ***H01R 4/64*** | (2006.01) |
| ***H01R 4/66*** | (2006.01) |

(52) U.S. Cl.

CPC ..... *H01R 4/40* (2013.01); *H01R 4/26* (2013.01); *H01R 4/38* (2013.01); *H01R 4/64* (2013.01); *H01R 4/66* (2013.01); *H01R 43/20* (2013.01)

(58) Field of Classification Search

CPC ..... H01R 4/643; H01R 4/2404; H01R 4/46; H01R 4/40

See application file for complete search history.

(56) References Cited

U.S. PATENT DOCUMENTS

| | | | | |
|---|---|---|---|---|
| 2,038,436 | A | 4/1936 | Mangin | |
| 2,122,547 | A * | 7/1938 | Borden | H01R 4/38 439/208 |
| 2,566,725 | A * | 9/1951 | Hoadley | H01R 11/15 29/872 |
| 2,701,351 | A | 2/1955 | Weber | |
| 3,727,266 | A | 4/1973 | Ashworth | |
| 3,901,577 | A | 8/1975 | Philibert et al. | |
| 4,079,487 | A | 3/1978 | Coop, Sr. | |
| 4,776,808 | A | 10/1988 | Davidson | |
| 4,863,390 | A | 9/1989 | Cera et al. | |
| 4,875,864 | A | 10/1989 | Campbell | |
| 4,976,627 | A | 12/1990 | O'Loughlin | |
| 5,004,437 | A | 4/1991 | Walter et al. | |
| 5,152,701 | A | 10/1992 | Polidori | |
| 5,286,211 | A | 2/1994 | McIntosh | |
| 5,320,565 | A | 6/1994 | Polidori | |

(Continued)

*Primary Examiner* — Briggitte R Hammond
(74) *Attorney, Agent, or Firm* — Hoffmann & Baron, LLP

(57) ABSTRACT

An electrical grounding clamp is provided, wherein the clamp includes a U-bolt, an inner clamp part connected to the U-bolt to clamp a floor support between the inner clamp part and the U-bolt and an outer clamp part connected to the U-bolt to clamp a conductor between the inner clamp part and the outer clamp part, wherein at least one of the inner clamp part and the outer clamp part is pivotable about one leg of the U-bolt to releasably engage the other leg of the U-bolt.

14 Claims, 7 Drawing Sheets

(56) References Cited

U.S. PATENT DOCUMENTS

| | | | |
|---|---|---|---|
| 5,632,633 | A | 5/1997 | Roosdorp et al. |
| 5,772,455 | A | 6/1998 | Auclair et al. |
| 5,888,104 | A | 3/1999 | Mello et al. |
| 6,986,673 | B2 | 1/2006 | de la Borbolla |
| 7,637,754 | B1 | 12/2009 | Yerena et al. |
| 7,703,722 | B2 | 4/2010 | Bucciferro et al. |
| 7,708,234 | B2 | 5/2010 | Kossak |
| 7,794,243 | B1 | 9/2010 | Rzasa et al. |
| 7,803,001 | B2 | 9/2010 | Wason |
| 7,988,464 | B2 | 8/2011 | Kossak et al. |
| 8,038,453 | B2 | 10/2011 | Robicheau et al. |
| 8,313,334 | B2 | 11/2012 | Ruland |
| 8,341,822 | B2 | 1/2013 | Rzasa et al. |
| 8,864,502 | B2 | 10/2014 | Dinh |
| 2010/0221934 | A1 | 9/2010 | Robicheau et al. |
| 2011/0065333 | A1 | 3/2011 | Ruland |

* cited by examiner

FLOOR GROUND CLAMP

CROSS-REFERENCE TO RELATED APPLICATIONS

This application claims priority from U.S. provisional application Ser. No. 62/164,074, filed on May 20, 2015, the specification of which is incorporated herein in its entirety for all purposes.

TECHNICAL FIELD

The present invention relates generally to a cable connector for electrically and mechanically connecting an electrical conductor to a metallic structural member. More particularly, the present invention relates to a floor ground clamp for attaching one or more conductors to a support structure for use as a signal reference grid.

BACKGROUND

Grounding of electrical systems is a practice which accomplishes multiple functions. Foremost among these functions is the avoidance of shock hazard due to lightning, power surges, ground faults and inadvertent contact with high voltage lines. To prevent personal injury due to such electrical hazards, it has long been known in the electrical field to use low resistance ground connections to earth.

However, with the advent and widespread use of highly sensitive computer components, grounding has also been identified as necessary for the reliable operation of such components. Typically, computers and other advanced data processing equipment are housed and used in a dedicated room or area in a commercial building. These rooms are usually well air-conditioned to avoid equipment over-heating and thus have low-humidity level. Computer operators and other personnel working in these areas can create a build-up of static electricity in their body as a result of movement in this dry environment. Subsequent contact with static sensitive computer equipment can dissipate this static charge through the equipment, impeding its operating reliability. Therefore, static shielding of computer equipment is highly desirable. Further, the signal frequencies of high speed computers reach and exceed 10 megahertz. The radiation of these high frequencies also proves to be troublesome to computer operation. Thus, shielding of computer circuits from such signal "noise" is also advantageous.

One method currently practiced in providing signal and static grounding is to employ a signal reference grid beneath the floor supporting the computer equipment. The signal reference grid, which is typically run in a tortuous path beneath the floor, is electrically connected along its length to the various computer components and at one end directly or indirectly to earth. This provides adequate signal grounding, thus reducing signal "noise" radiated at high frequencies. Further, the signal reference grid is also useful in providing static protection to the computer hardware. The raised flooring in a computer area is typically formed of a semi-conductive material, and is supported on modular floor supports made of steel or aluminum. It is desirous to electrically connect the floor supports to the signal reference grid thus placing the floor and the computer terminals at the same electrical potential. A computer operator standing on the semi-conductive floor will thus be at the same electrical potential as the computer terminal, eliminating any chances of static dissipation between the operator and the terminal.

The art has seen various types of grounding connectors and the like which ground such electrical conductors to such floor supports. Also, various types of connectors that provide for the crossover of two conductors are known. Examples of these are shown in U.S. Pat. Nos. 4,967,627; 5,888,104; and 7,803,001. However, these connectors can be cumbersome to use, often require special tools and/or require special hardware.

Accordingly, it would be desirable to provide a simple, inexpensive floor ground clamp that is quick to install, and requires no special tools or hardware.

SUMMARY

In one aspect of the present invention, an electrical grounding clamp is provided, wherein the clamp includes a U-bolt, an inner clamp part connected to the U-bolt to clamp a floor support between the inner clamp part and the U-bolt and an outer clamp part connected to the U-bolt to clamp a conductor between the inner clamp part and the outer clamp part, wherein at least one of the inner clamp part and the outer clamp part is pivotable about one leg of the U-bolt to releasably engage the other leg of the U-bolt.

In a preferred embodiment, the pivotable clamp part defines an enclosed hole for receiving the one leg of the U-bolt and an opposite open hole having a non-continuous circumference for releasably engaging the outer leg of the U-bolt. More preferably, both the inner and outer clamp parts are pivotable about a leg of the U-bolt.

The inner clamp part preferably includes a pair of parallel first conductor contact surfaces facing outwardly toward the open end of the U-bolt and a pair of parallel second conductor contact surfaces facing toward the open end of the U-bolt, wherein the first conductor contact surfaces are generally perpendicular to the second conductor contact surface. The conductor contact surfaces preferably include a plurality of conductor gripping ribs rising outwardly from the surface, wherein the ribs extend in a transverse direction across the conductor contact surfaces. The conductor contact surfaces are also preferably bounded on one side by a retaining wall formed on an edge of the inner clamp part.

The inner clamp part preferably includes a first leg and a second leg extending generally perpendicular from the first leg, wherein the second leg meets the first leg at an apex to form a V-shape. The inner clamp part further preferably includes a locating protrusion extending outwardly from the apex for facilitating alignment between the inner and outer clamp parts. In this regard, the outer clamp part is preferably formed with an aperture for receiving the locating protrusion of the inner clamp part.

Features of the disclosure will become apparent from the following detailed description considered in conjunction with the accompanying drawings. It is to be understood, however, that the drawings are designed as an illustration only and not as a definition of the limits of this disclosure.

DETAILED DESCRIPTION OF PREFERRED EMBODIMENTS

Figure 1:
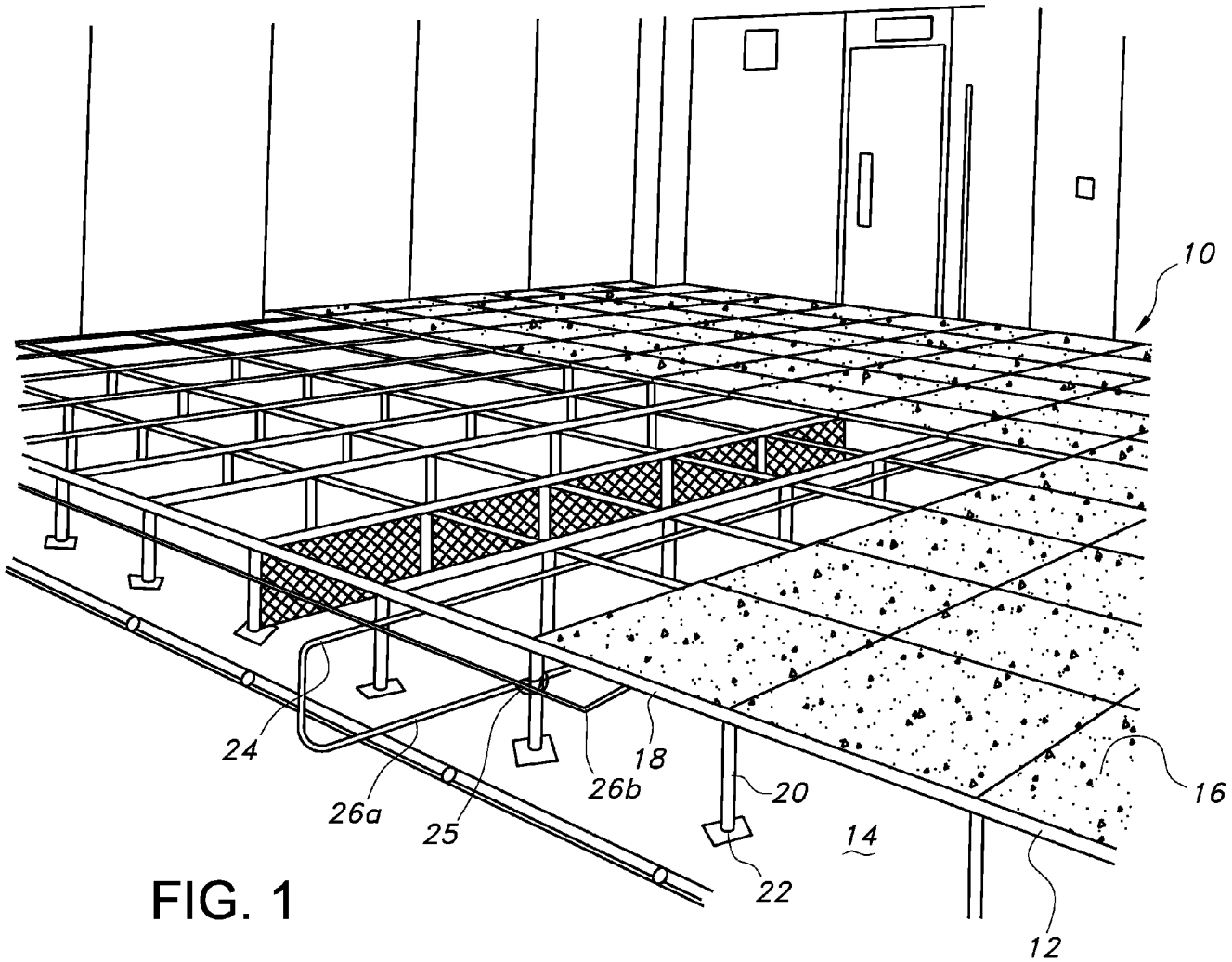
FIG. 1 shows a typical computer equipment room having floor panels supported by floor supports and also shows an under floor signal reference grid running therebelow.
Figure 2:
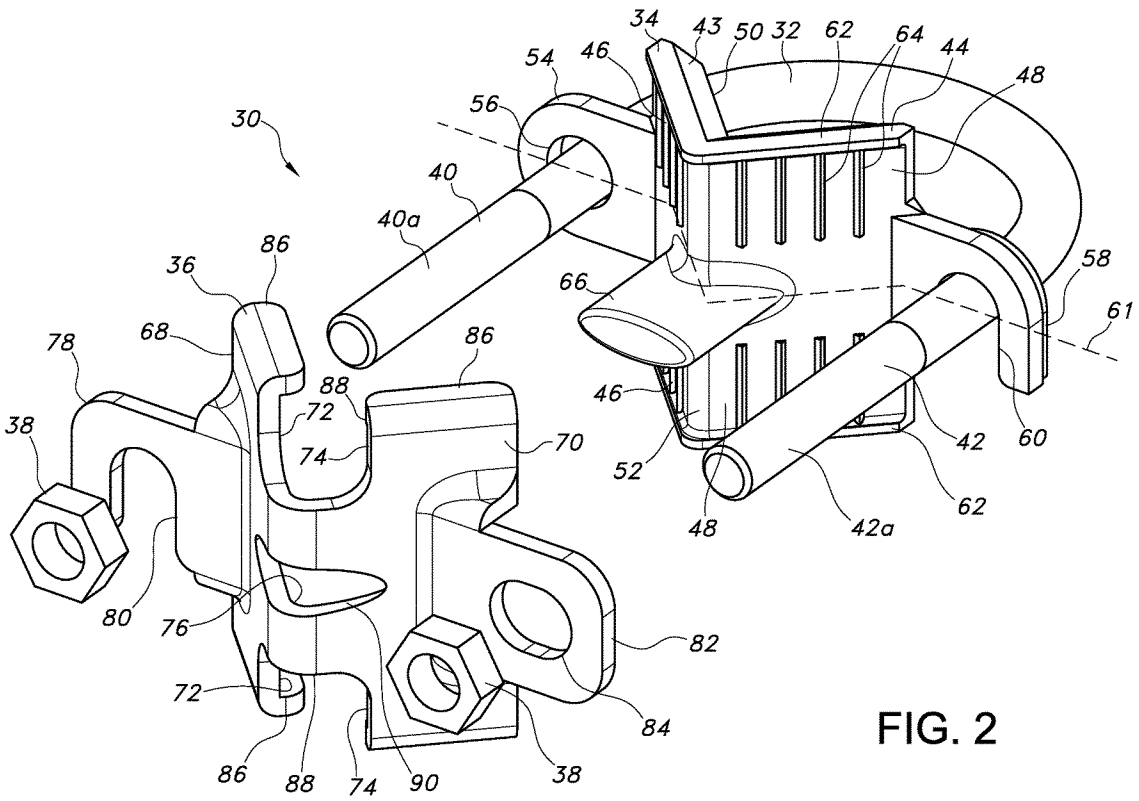
FIG. 2 is an exploded perspective view of the floor ground clamp formed in accordance with the present invention.

FIG. 1 shows a typical computer equipment room 10 including floor support structures 12 which form a grid type pattern across and raised from the floor 14. The floor support structure 12 supports rectangular floor elements 16. The floor support structure 12 is comprised of cross members 18 and upright supports 20 which are formed of steel, aluminum or other conductive metal. The floor elements 16 are formed of a semi-conductive material or of a floor material having conductive particles impregnated therein. In most computer equipment installations, the supporting floor elements 16 are raised above the floor 14 to accommodate the flow of cooled air necessary for efficient operation of computer equipment.

As mentioned above, it becomes advantageous to place the computer operator at the same electrical potential as the computer equipment. Thus the conductive floor elements 16 supported by conductive floor support structure 12 are designed to support both the computer equipment (not shown) and the operator (also not shown). As the floor support structure 12 is primarily designed for mechanical strength and stability, the electrical continuity between cross members 18 and upright supports 20 may not be assured. This is particularly true where the upright supports 20 may be secured to a floor plate 22, which is attached to the floor 14 by mastic, glue or other insulative material which would insulate the support structure 12 from ground.

In order to place the support structure 12 at ground potential across the entire floor, a signal reference ground grid 24 is often employed. Shown raised from floor 14 beneath support structure 12, the ground grid 24 comprises one or more lengths of bare or insulated wires 26*a* and 26*b* (generally referred to as wire 26), which are mechanically and electrically secured to the upright supports 20 of support structure 12 at schematically shown connections 25. The wire 26 is secured to multiple upright supports 20 to provide plural electrical connections. Multiple areas of connection to the support structure 12 are highly desirable as plural connections form parallel paths of electrical continuity. This substantially reduces the impedance level at high frequencies. The wire 26 is then connected to ground (not shown) to place the grid 24 and the support structure 12 at ground potential. As the floor elements 16 are formed of conductive material, both the computer equipment and operator supported on the floor elements 16 will be the same ground potential, thus eliminating any static dissipation between the operator and the equipment.

Referring now to FIGS. 2 through 7, the present invention provides an electrical connector 30 suitable for connecting wires 26*a* and 26*b* of signal reference grid 24 to the upright support 20 of support structure 12. The electrical grounding connector 30 of the present invention generally includes a U-bolt 32, an inner clamp part 34, an outer clamp part 36, and two nuts 38. The inner clamp part 34 is connected to the U-bolt 32 to clamp a cylindrical section 20 of the floor pedestal therebetween. Clamping the inner clamp part 34 to the floor pedestal establishes an electrical connection between the connector 30 and the pedestal. The outer clamp part 36 is connected to the inner clamp part 34 and the U-bolt 32 to clamp one or more conductors 26*a*, 26*b* between the inner clamp part 34 and the outer clamp part 36. Clamping a conductor between the inner clamp part 34 and the outer clamp part 36 creates an electrical connection between the connector 30 and the clamped conductor. As a result, the floor pedestal is electrically connected by the grounding connector 30 to the conductor.

Figure 4:
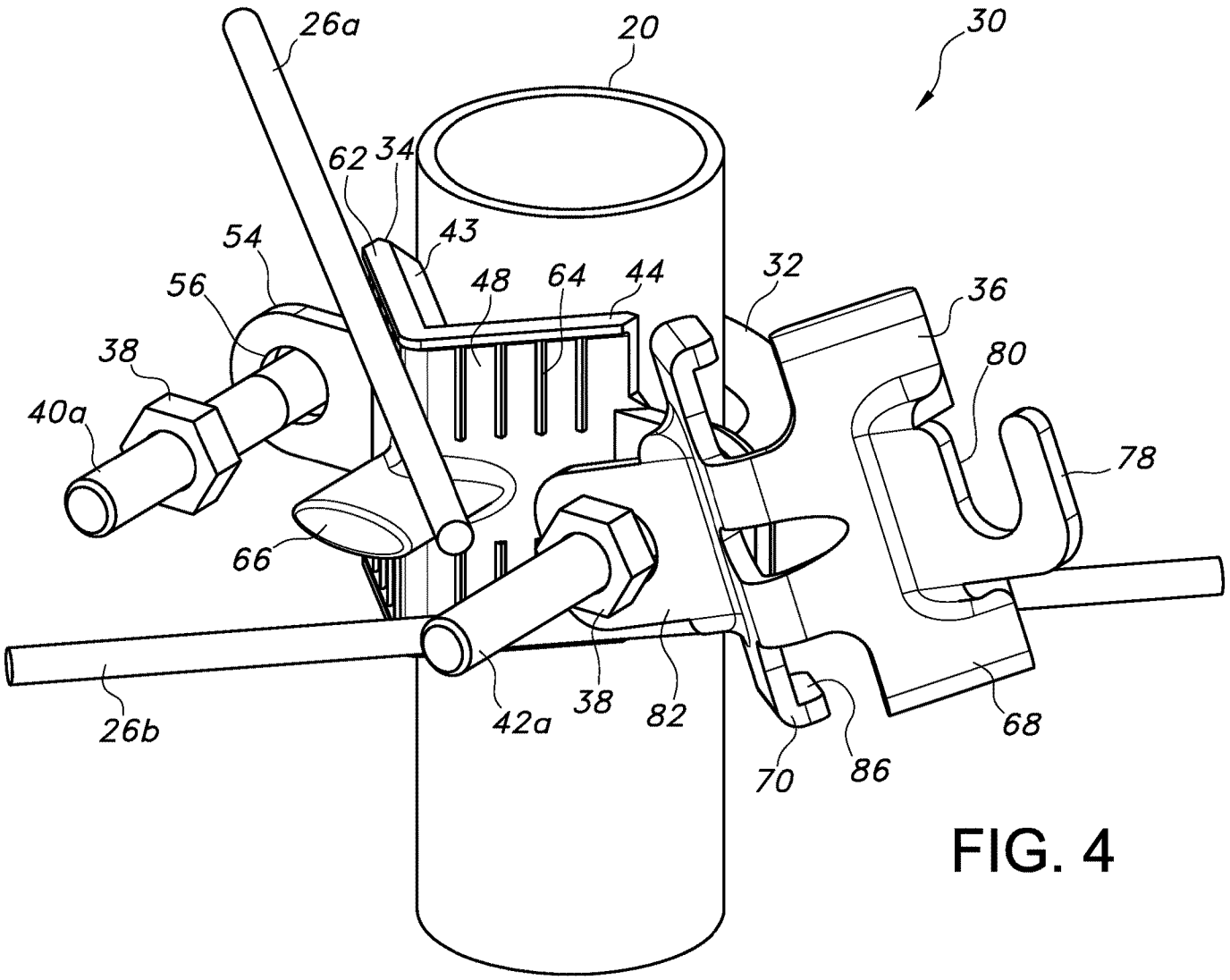
FIG. 4 is a perspective view of the floor ground clamp shown in FIG. 3 in a further assembled state.
Figure 5:
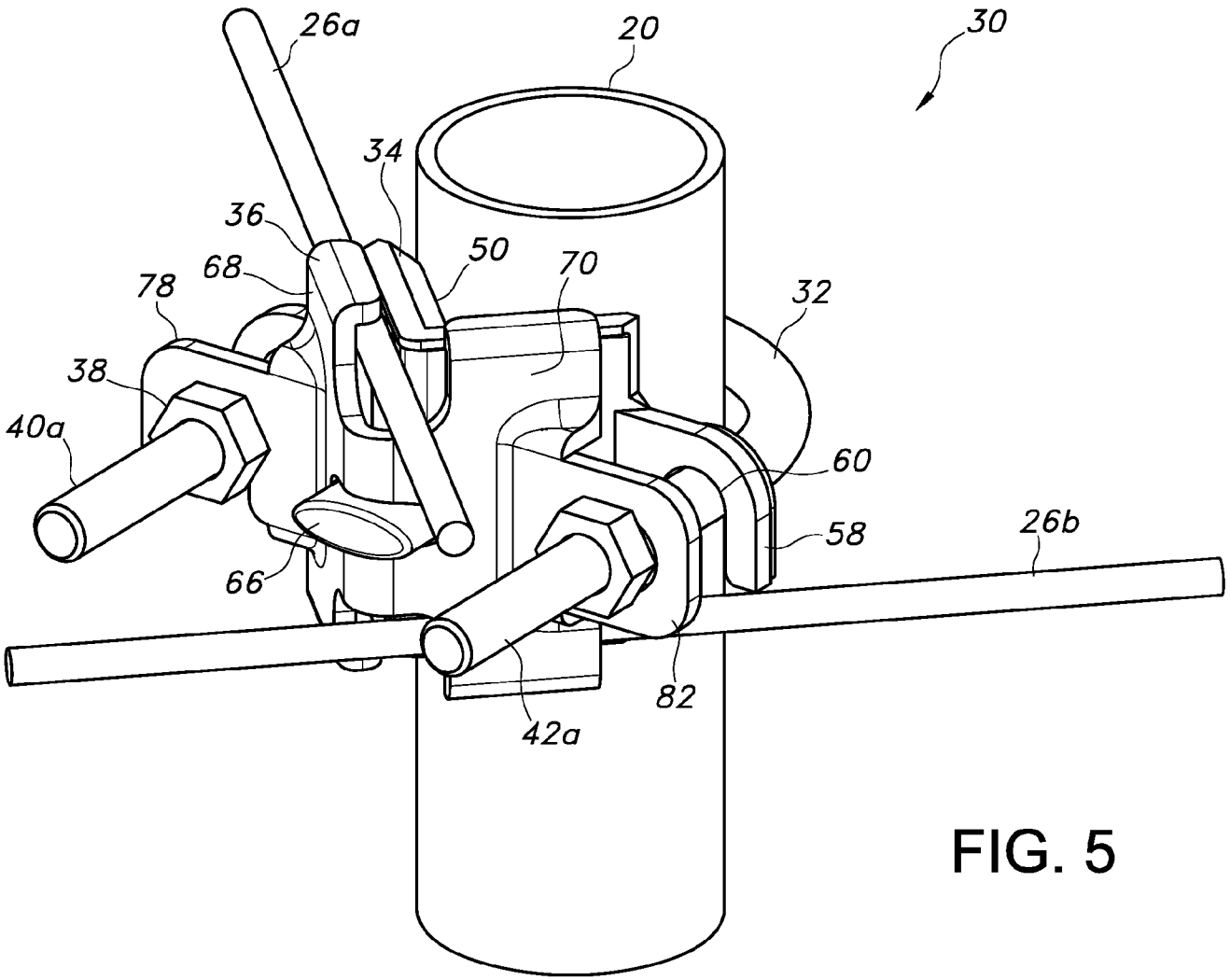
FIG. 5 is a perspective view of the floor ground clamp according to the present invention in a fully assembled state clamping two conductors in an exemplary orientation.
Figure 6:
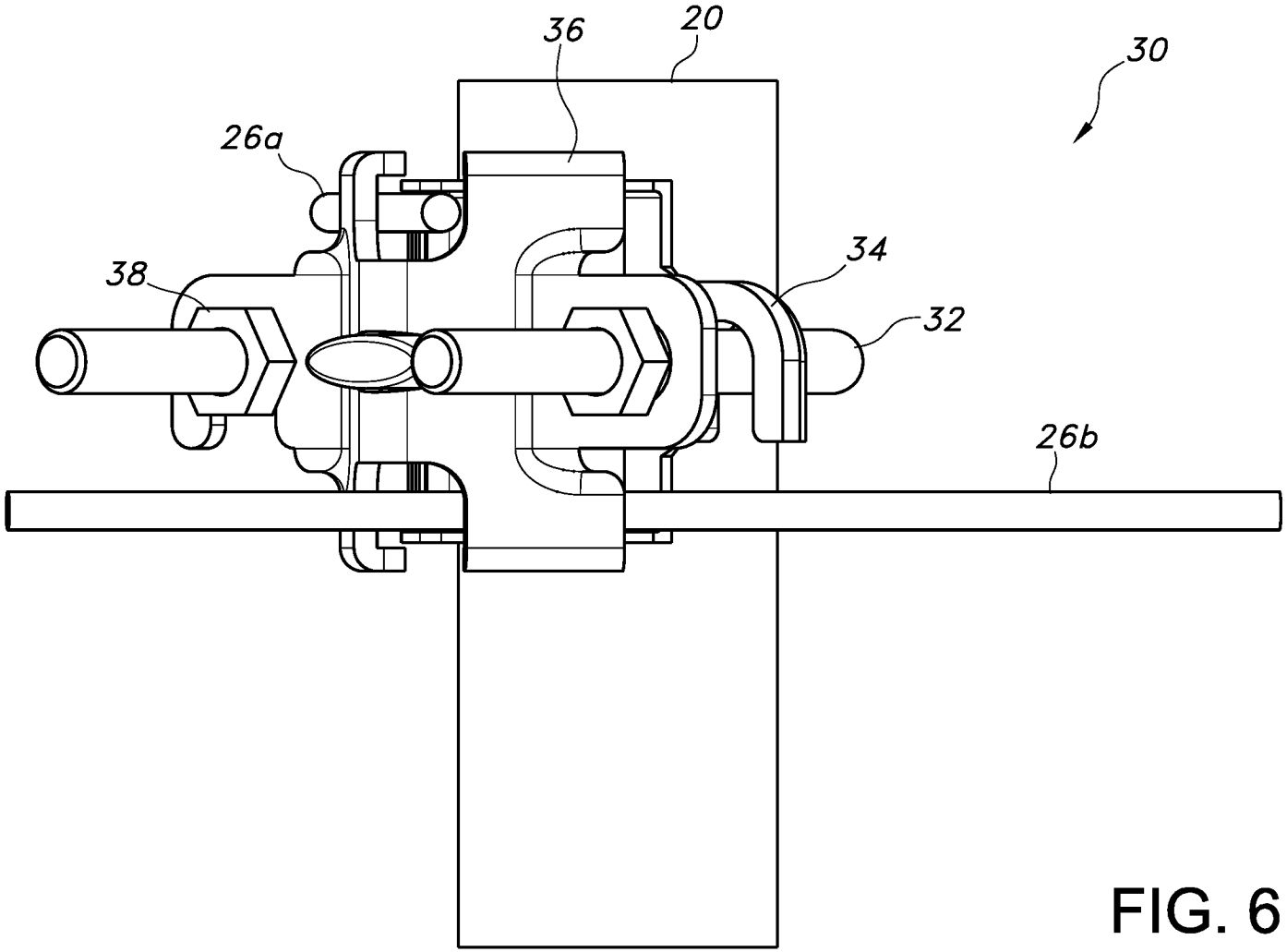
FIG. 6 is a front view of the assembled floor ground clamp shown in FIG. 5.
Figure 7:
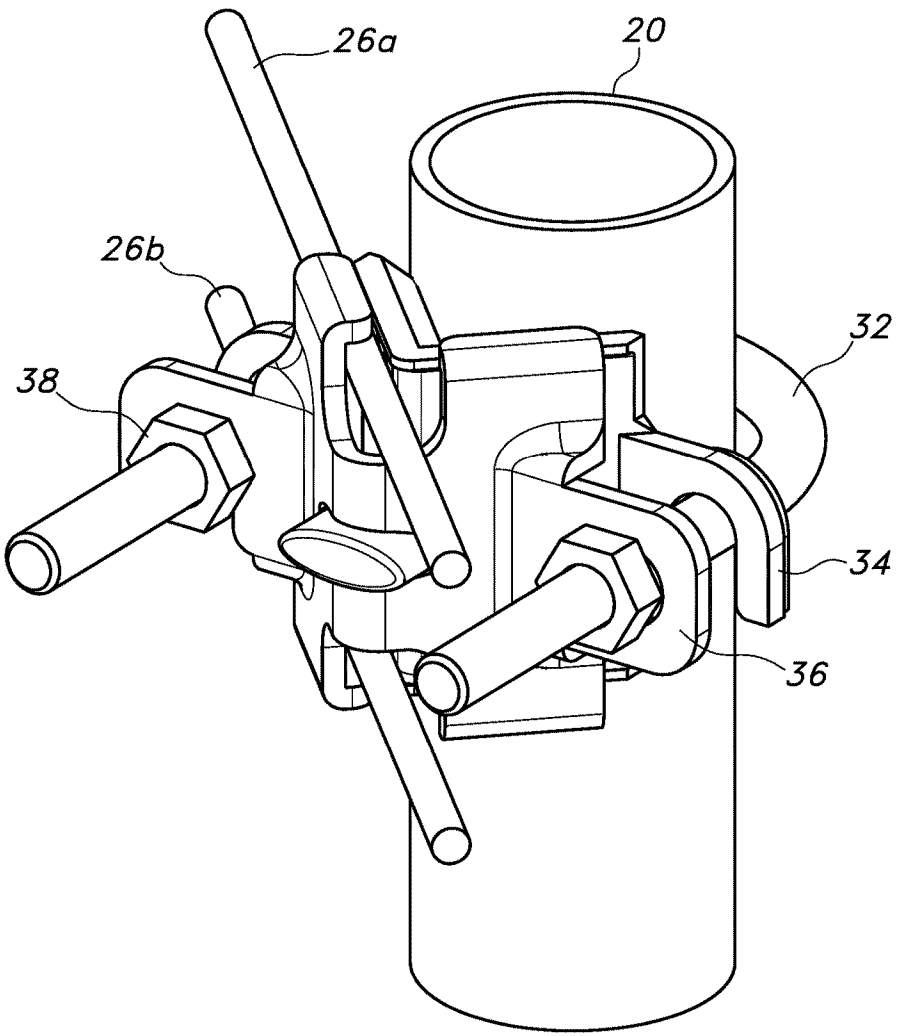
FIG. 7 is a perspective view of the floor ground clamp according to the present invention in a fully assembled state clamping two conductors in an alternative orientation.

FIGS. 4-6 show use of the connector 30 to connect two conductors 26*a*, 26*b* in a perpendicular grid grounding network, wherein the conductor cables 26*a*, 26*b* are perpendicular to each other. FIG. 7 shows the same connector 30 in a parallel grid grounding network wherein the conductor cables 26*a*, 26*b* are parallel to each other.

The U-blot 32 has two legs 40, 42, with each leg having an externally threaded end 40*a*, 42*a*. The nuts 38, and possible lock washers (not shown), are sized and internally threaded to attach to the threaded ends 40*a*, 42*a* of the legs. When the components are assembled, the U-bolt 32 and nuts 38 can clamp the inner and outer clamp parts 34, 36 towards the floor pedestal, and also to thereby clamp the conductors 26*a*, 26*b* between the clamp parts.

The inner clamp part 34 is preferably a one-piece member comprised of an electrically conductive metal, such as cast metal for example. The inner clamp part 34 has a general right angle shape or general V shape. Specifically, the inner clamp part 34 has a plate-shaped first leg 43 and a plate-shaped second leg 44, wherein the second leg 44 is angled relative to the first leg 43 at an angle of about 90 degrees. The first leg 43 has two conductor contact surfaces 46, which are parallel to each other, provided on its outwardly facing exterior side and the second leg 44 has two conductor contact surfaces 48, which are parallel to each other, provided on its outwardly facing exterior side. The inner facing sides of the legs 43, 44, opposite the conductor contact surfaces, define a contact and mounting surface 50 which is sized and shaped to contact and mount against the floor support 20.

The two conductor contact surfaces 46 of the first leg 43 are generally orthogonal to the two conductor contact surfaces 48 of the second leg 44. The two conductor contact surfaces 46 of the first leg 43 meet the two conductor contact surfaces 48 of the second leg 44 at an apex 52 of the V-shaped inner clamp part 34 where the first leg 43 intersects with the second leg 44. Provided on the distal end of the first leg 43 opposite the apex 52 is a first ear 54 defining an aperture 56 for receiving one leg 40 of the U-bolt 32. Similarly, the distal end of the second leg 44 is provided with a second ear 58 defining an aperture 60 for receiving the other leg 42 of the U-bolt 32.

In a preferred embodiment, the first ear 54 includes an aperture 56 defining a circumferentially enclosed hole. In this embodiment, the second ear 58 includes an aperture 60 defining a hole whose circumference is partially open. As will be discussed in further detail below, the partially opened hole 60 of the second ear 58 allows the inner clamp part 34 to swing out of engagement with one leg 42 of the U-bolt 32 upon loosening the nuts 38. This feature provides the advantage of clamping and unclamping of the connector 30 without the need to completely remove the nuts 38 from the U-bolt 32.

The axis of the hole 56 of the first ear 54 is located on a plane 61 defined perpendicularly between the two conductor contact surfaces 46 of the first leg 43 and the open aperture 60 of the second ear 58 is similarly located on the plane where the two conductor contact surfaces 48 of the second leg 44 meet. The central axes of the holes 56, 60 are, thus, parallel to each other and are spaced a distance equivalent to the distance between the two legs 40, 42 of the U-bolt 32.

In a preferred embodiment, the first and second legs 43, 44 of the inner clamp part 34 are formed with walls 62 rising upwardly from the conductor contact surfaces 46, 48 at lateral edges thereof. The walls 62 meet at the apex 52 of the legs and extend toward the opposite ears 54, 58. The walls 62 bound one edge of the conductor contact surfaces 46, 48 to prevent the conductors 26*a*, 26*b* from slipping off their respective surfaces upon assembly.

The conductor contact surfaces 46, 48 are further preferably provided with one or more conductor gripping ribs 64 to further facilitate retention of the conductors 26*a*, 26*b*. These ribs 64 rise outwardly from the conductor contact surfaces 46, 48 and preferably extend in a lateral direction across the conductor contact surfaces perpendicular to the direction of the walls 62.

The inner clamp part 34 further preferably includes a locating protrusion 66 rising outwardly from the apex 52 between the first and second legs 43, 44. The locating protrusion 66 is preferably located on the plane dividing the conductor contact surfaces and is, therefore, in line with the two apertures 56, 60 provided in the ears 54, 58 of the inner clamp part 34. In this manner, the locating protrusion 66 further separates the two conductor contact surfaces 46 of the first leg 43 from one another and further separates the two conductor contact surfaces 48 of the second leg 44 from one another. The protrusion 66 may take various shapes and has a height measured in a direction away from the conductor contact surfaces. The height of the protrusion 66 is such as to enable the protrusion to engage the outer clamp part 36 with a conductor clamped between the inner and outer clamp parts. As will be discussed in further detail below, the protrusion 66 provides for positive location between the inner and outer clamp parts 34, 36 when assembling the ground clamp 30.

As mentioned above, the ground clamp 30 of the present invention includes an outer clamp part 36 that cooperates with the inner clamp part 34 and the U-bolt 32 to clamp one or more conductors between the inner and outer clamp parts. The outer clamp part 36 is also preferably a one-piece member comprised of an electrically conductive metal, such as cast metal for example.

Like the inner clamp part 34, the outer clamp part 36 has a general right angle shape or general V shape. Thus, the outer clamp part 36 also has a plate-shaped first leg 68 and a plate-shaped second leg 70, wherein the second leg 70 is angled relative to the first leg 68 at an angle of about 90 degrees to match the first and second legs of the inner clamp part 34. The first leg 68 similarly has two conductor contact surfaces 72, which are parallel to each other, provided on its inwardly facing interior side and the second leg 70 has two conductor contact surfaces 74, which are parallel to each other, provided on its inwardly facing interior side, wherein the conductor contact surfaces of the outer clamp part respectively face the conductor contact surfaces of the inner clamp part.

The two conductor contact surfaces 72 of the first leg 68 are generally orthogonal to the two conductor contact surfaces 74 of the second leg 70 and meet at an inner corner 76 of the outer clamp part 36. Provided on the distal end of the first leg 68 opposite the corner 76 is a first ear 78 defining an aperture 80 for receiving one leg 40 of the U-bolt 32. Similarly, the distal end of the second leg 70 is provided with a second ear 82 defining an aperture 84 for receiving the other leg 42 of the U-bolt 32.

As described above with respect to the inner clamp part 34, in a preferred embodiment, one of the ears 82 of the outer clamp part includes an aperture 84 defining a circumferentially enclosed hole. The other ear 78 includes an aperture 80 defining a hole whose circumference is partially open. As will be discussed in further detail below, the opened hole 80 of one ear 78 allows the outer clamp part 36 to swing out of engagement with one leg of the U-bolt 32 upon loosening the nuts 38. This feature provides the advantage of clamping and unclamping of the connector 30 without the need to completely remove the nuts 38 from the U-bolt 32.

The aperture 80 of the first ear 78 is located on the plane 61 defined between the two conductor contact surfaces 72 of the first leg 68 and the aperture 84 of the second ear 82 is similarly located between the two conductor contact surfaces 74 of the second leg 70 of the outer clamp part 34. The axes of the holes 80, 84 are parallel to each other and are spaced a distance equivalent to the distance between the two legs 40, 42 of the U-bolt 32. The outer facing surfaces of the first and second ears 78, 82 around the holes 80, 84 form seats for the lock washers (not shown) and nuts 38.

In a preferred embodiment, the first and second legs 68, 70 of the outer clamp part 36 are also formed with walls 86 rising upwardly from the conductor contact surfaces 72, 74 at lateral edges thereof. The walls 86 of the outer clamp part 36 extend toward the walls 62 of the inner clamp part 34 and bound one edge of the conductor contact surfaces 72, 74 to prevent the conductors 26*a*, 26*b* from slipping off their respective surface upon assembly. Also, the conductor contact surfaces 72, 74 may also be provided with one or more conductor gripping ribs (not shown), as described above with respect to the inner clamp part, to further facilitate retention of the conductors 26*a*, 26*b*.

However, unlike the inner clamp part, the conductor contact surfaces 72 of the first leg 68 do not fully meet the conductor contact surfaces 74 of the second leg 70. Instead, an opening 88 is provided at the top and bottom of the corner 76 of the outer clamp part 36 to allow passage of the clamped conductors.

The outer clamp part 36 further includes an aperture 90 sized and shaped to receive the locating protrusion 66 of the inner clamp part 34 The aperture 90 is formed in the corner 76 of the outer clamp part 36 between the first and second legs 68, 70. The protrusion receiving aperture 90 is located on the plane 61 dividing the conductor contact surfaces and is, therefore, in line with the two apertures 80, 84 provided in the ears 78, 82 of the outer clamp part 36.

Figure 3:
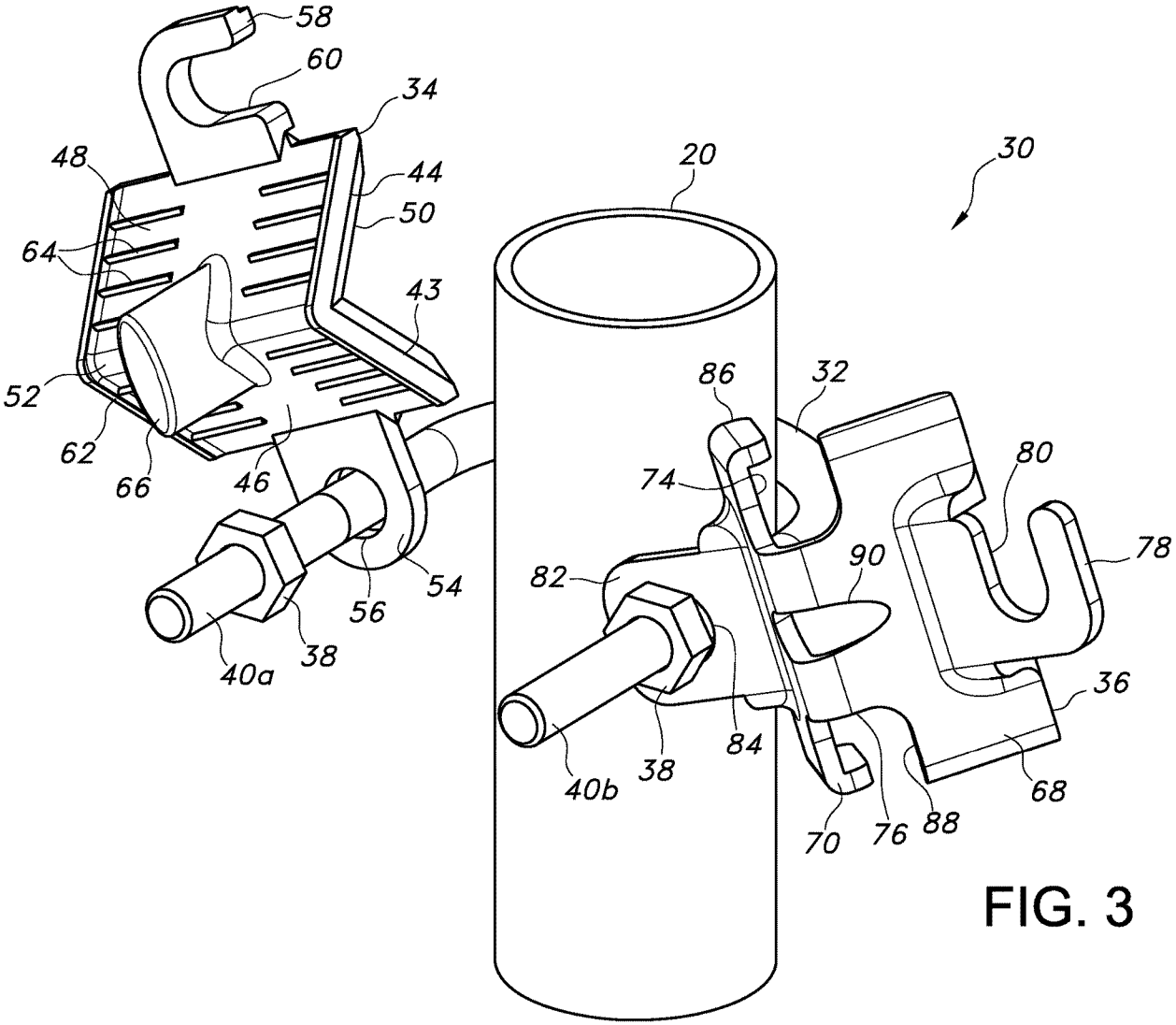
FIG. 3 is a perspective view of the floor ground clamp shown in FIG. 2 in a partially assembled state.

As seen in FIGS. 3-7, the ground connection between the floor support 20 and the tap conductors 26*a*, 26*b* is formed by clamping the grounding clamp 30 to the floor support 20 and connecting the tap conductors 26*a*, 26*b* to the grounding clamp 30. To clamp the grounding clamp 30 to the floor support 20, the U-bolt 32 is placed against the cylindrical section of the floor support 20 so that a portion thereof is located between the two legs 40, 42 of the U-bolt. As can be seen in FIG. 3, the swing-out nature of the inner and outer clamp parts 34, 36 allows the clamp 30 to be pre-assembled upon installation. Specifically, one leg 40 of the U-bolt 32 can be inserted through the enclosed hole 56 of the inner clamp part 34 so that the conductor contact surfaces 46, 48 face the open ends of the U-bolt legs. Similarly, the other leg 42 of the U-bolt can be inserted through the enclosed hole 84 of the outer clamp part 36 so that the conductor contact surfaces 72, 74 face the closed curve of the U-bolt. Preassembly of the clamp 30 is completed by partially threading the nuts 38 onto the threaded ends 40*a*, 42*a* of the U-bolt 32.

Once the U-bolt 32 is positioned around the floor support 20, the inner clamp part 34 is pivoted about the enclosed hole 56 of the first ear 54 into a position, wherein the open hole 60 of the second ear 58 receives and engages the second leg 42 of the U-bolt. In this position, the inner facing mounting surface 50 of the inner clamp part faces the floor support 20 and the conductor contact surfaces 46, 48 face outwardly away from the floor support.

One or more conductors 26*a*, 26*b* can then be positioned against the conductor contact surfaces 46, 48 of the inner clamp part 34 as desired. For example, two perpendicular conductors can be positioned against orthogonal conductor contact surfaces 46, 48 face, as shown in FIGS. 4-6, or two parallel conductors can be positioned against one pair of parallel conductor contact surfaces 46, as shown in FIG. 7.

Once the one or more conductors are positioned, the outer clamp part 36 is swung into position in a similar manner as the inner clamp part 34. Specifically, the outer clamp part 36 is pivoted about the enclosed hole 84 of the second ear 82 into a position wherein the open hole 80 of the first ear 78 receives and engages the first leg 40 of the U-bolt. In this position, the inner facing conductor contact surfaces 72, 74 of the outer clamp part 36 faces the conductor contact surfaces 46, 48 of the inner clamp part 34 with the conductors positioned therebetween.

The outer clamp part 36 is mated to the inner clamp part 34 by tightening the nuts 38 with a suitable wrench (not shown). When mating the outer clamp part 36 and the inner clamp part 34, the locating protrusion 66 of the inner clamp part 34 is received in the opening 90 of the outer clamp part 36, thereby aligning the conductor contact surfaces 46, 48 of the inner clamp part 34 with the conductor contact surfaces 72, 74 of the outer clamp part 36. The ground clamp assembly is fully completed by fully tightening the nuts 38 to clamp both the floor support 20 between the inner clamp part 34 and the U-bolt 32, as well as to clamp the conductors between the inner and outer clamp parts.

The present invention, as shown herein, is particularly useful in electrically connecting one or more wires 26 to the support structure 12 of a raised floor system. However, the concepts of the present invention may be employed in a simple electrical connector which connects one conductor to another without further connecting the conductors to a support structure.

Additionally, the present invention is not limited in use for making ground connections in computer room applications. Rather, the present invention may also be used to make ground connections in other environments such as underground cable or overhead suspended cable. It is even contemplated that in certain limited applications the connector of the present invention may make power connections.

It should be apparent to those skilled in the art that the described embodiments of the present invention provided herein are illustrative only and not limiting, having been presented by way of example only. As described herein, all features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. While various embodiments of the present invention are specifically illustrated and/or described herein, it will be appreciated that modifications and variations of the present invention may be effected by those skilled in the art without departing from the spirit and intended scope of the invention.

All documents, patents and other literature referred to herein are incorporated by reference in their entirety.

The term "comprising" as may be used in the following claims is an open-ended transitional term that is intended to include additional elements not specifically recited in the claims. The term "consisting essentially of" as may be used in the following claims is a partially closed transitional phrase and is intended to include the recited elements plus any unspecified elements that do not materially affect the basic and novel characteristics of the claims. For example, the cable tie may be embossed or printed with indicia and still be included in the meaning of "consisting essentially of", even if not specifically recited. The term "consisting of" as may be used in the following claims is intended to indicate that the claims are restricted to the recited elements.

It should be noted that it is envisioned that any feature, element or limitation that is positively identified in this document may also be specifically excluded as a feature, element or limitation of an embodiment of the present invention.

What is claimed is:

1. An electrical grounding clamp comprising:

a U-bolt;

an inner clamp part connected to the U-bolt to clamp a floor support between the inner clamp part and the U-bolt; and an outer clamp part connected to the U-bolt to clamp a conductor between the inner clamp part and the outer clamp part, wherein the inner clamp part comprises:

a body portion;

a first ear extending outwardly from the body portion, the first ear having an aperture defining a circumferentially closed hole, the hole receiving a first leg of the U-bolt; and a second ear extending outwardly from the body portion opposite the first ear, the second ear having a slot-shaped aperture defining a hole whose circumference is partially open, the slot-shaped aperture receiving a second leg of the U-bolt, and wherein the outer clamp part comprises:

a body portion having a first leg connected to a second leg at a generally perpendicular angle, the first leg having an upper conductor contact surface and a lower conductor contact surface parallel to the upper conductor contact surface, and the second leg having an upper conductor contact surface and a lower conductor contact surface parallel to the upper conductor contact surface, the body portion further having an upper opening formed in a corner thereof and separating the upper conductor contact surfaces of the first and second legs, and further having a lower opening formed in a corner thereof and separating the lower conductor contact surfaces of the first and second legs;

a first ear extending outwardly from the body portion, the first ear having an aperture defining a circumferentially closed hole, the hole receiving a first leg of the U-bolt; and a second ear extending outwardly from the body portion opposite the first ear, the second ear having a slot-shaped aperture defining a hole whose circumference is partially open, the slot-shaped aperture receiving a second leg of the U-bolt, and wherein both the inner clamp part and the outer clamp part are pivotable about one leg of the U-bolt to releasably engage the other leg of the U-bolt.

2. An electrical grounding clamp comprising:

a U-bolt;

an inner clamp part connected to the U-bolt to clamp a floor support between the inner clamp part and the U-bolt; and an outer clamp part connected to the U-bolt to clamp a conductor between the inner clamp part and the outer clamp part, wherein at least one of the inner clamp part and the outer clamp part is pivotable about one leg of the U-bolt to releasably engage the other leg of the U-bolt, and wherein the inner clamp part comprises a pair of parallel first conductor contact surfaces facing outwardly toward the open end of the U-bolt and a pair of parallel second conductor contact surfaces facing toward the open end of the U-bolt, the first conductor contact surfaces being generally perpendicular to the second conductor contact surface, and wherein at least one of the first and second conductor contact surfaces includes a plurality of conductor gripping ribs rising outwardly from the surface.

3. The electrical grounding clamp as defined in claim 2, wherein the plurality of conductor gripping ribs extend in a transverse direction across the conductor contact surfaces.

4. The electrical grounding clamp as defined in claim 2, wherein the inner clamp part comprises:

a first leg;

a second leg extending generally perpendicular from the first leg, the second leg meeting the first leg at an apex to form a V-shape; and a locating protrusion extending outwardly from the apex for facilitating alignment between the inner and outer clamp parts.

5. An electrical grounding clamp comprising:

a U-bolt:

an inner clamp part connected to the U-bolt to clamp a floor support between the inner clamp part and the U-bolt; and an outer clamp part connected to the U-bolt to clamp a conductor between the inner clamp part and the outer clamp part, wherein at least one of the inner clamp part and the outer clamp part is pivotable about one leg of the U-bolt to releasably engage the other leg of the U-bolt, and wherein the inner clamp part comprises:

a first leg;

a second leg extending generally perpendicular from the first leg, the second leg meeting the first leg at an apex to form a V-shape; and a locating protrusion extending outwardly from the apex for facilitating alignment between the inner and outer clamp parts, and wherein the outer clamp part is formed with an aperture for receiving the locating protrusion of the inner clamp part.

6. The electrical ground clamp as defined in claim 5, wherein the at least one pivotable clamp part defines an enclosed hole for receiving the one leg of the U-bolt and an opposite open hole having a non-continuous circumference for releasably engaging the other leg of the U-bolt.

7. The electrical grounding clamp as defined in claim 5, wherein both the inner and outer clamp parts are pivotable about a leg of the U-bolt.

8. The electrical grounding clamp as defined in claim 5, wherein the inner clamp part comprises a pair of parallel first conductor contact surfaces facing outwardly toward the open end of the U-bolt and a pair of parallel second conductor contact surfaces facing toward the open end of the U-bolt, the first conductor contact surfaces being generally perpendicular to the second conductor contact surface.

9. The electrical grounding clamp as defined in claim 5, wherein at least one of the first and second conductor contact surfaces is bounded on one side by a retaining wall formed on an edge of the inner clamp part.

10. The electrical grounding clamp as defined in claim 5, wherein the inner clamp part comprises:

a body portion;

a first ear extending outwardly from the body portion, the first ear having an aperture defining a circumferentially closed hole, the hole receiving a first leg of the U-bolt; and a second ear extending outwardly from the body portion opposite the first ear, the second ear having a slot-shaped aperture defining a hole whose circumference is partially open, the slot-shaped aperture receiving a second leg of the U-bolt.

11. The electrical grounding clamp as defined in claim 10, wherein the inner clamp part further comprises at least one first conductor contact surface facing toward the open end of the U-bolt and at least one second conductor contact surface facing toward the open end of the U-bolt, wherein the center axis of the hole of the first ear is disposed on a plane defined perpendicularly between the first and second conductor contact surfaces.

12. The electrical grounding clamp as defined in claim 11, wherein the first ear and second ear define a plane oriented at a 45° angle with respect to the first and second conductor contact surfaces.

13. The electrical grounding clamp as defined in claim 11, wherein the outer clamp part comprises:

a body portion;

a first ear extending outwardly from the body portion, the first ear having an aperture defining a circumferentially enclosed hole, the hole receiving one of the first and second legs of the U-bolt; and a second ear extending outwardly from the body portion opposite the first ear, the second ear having a slot-shaped aperture defining a hole whose circumference is partially open, the slot-shaped aperture receiving the other of the first and second legs of the U-bolt.

14. A method for forming a ground connection between a conductor wire and a floor support comprising:

placing a U-bolt around a section of a floor support such that the floor support is positioned between a first leg and a second leg of the U-bolt;

inserting the first leg of the U-bolt through a hole provided on an inner clamp part;

pivoting the inner clamp part about the first leg of the U-bolt such that a slot-shaped aperture of the inner clamp part engages the second leg of the U-bolt thereby enclosing the section of the floor support between the U-bolt and the inner clamp part;

placing a conductor wire against a conductor contact surface provided on the inner clamp part;

inserting one of the first and second legs of the U-bolt through a hole provided on an outer clamp part;

pivoting the outer clamp part about the one of the first and second legs of the U-bolt such that a slot-shaped aperture of the outer clamp part engages the other of the first and second legs of the U-bolt, thereby sandwiching the conductor between the inner and outer clamp parts;

clamping the U-bolt, the inner clamp part and the outer clamp part together; and locating the inner clamp part with respect to the outer clamp part by inserting a protrusion provided on one of the inner and outer clamp parts into an opening provided on the other of the inner and outer clamp parts.

* * * * *